US005176123A

United States Patent [19]

Hosoda et al.

[11] Patent Number: 5,176,123

[45] Date of Patent: Jan. 5, 1993

[54] EVAPORATIVE FUEL-PURGING CONTROL SYSTEM FOR INTERNAL COMBUSTION ENGINES

[75] Inventors: Fumio Hosoda; Sachito Fujimoto; Masakazu Kitamoto; Hideo Moriwaki; Takashi Kiyomiya; Koichi Hidano, all of Wako, Japan

[73] Assignee: Honda Giken Kogyo Kabushiki Kaisha, Tokyo, Japan

[21] Appl. No.: 876,997

[22] Filed: May 1, 1992

[30] Foreign Application Priority Data

Jun. 5, 1991 [JP] Japan ..... 3-161112

[51] Int. Cl.[5] ..... F02M 33/02

[52] U.S. Cl. ..... 123/520; 123/494; 123/357

[58] Field of Search ..... 123/518, 519, 520, 521, 123/357, 198 D, 494

[56] References Cited

U.S. PATENT DOCUMENTS

| | | | |
|---|---|---|---|
| 4,368,705 | 1/1983 | Stevenson | 123/357 |
| 4,493,303 | 7/1985 | Thompson | 123/357 |
| 4,537,172 | 8/1985 | Kanehara | 123/494 |
| 4,862,856 | 9/1989 | Yokoe | 123/520 |
| 4,867,126 | 9/1989 | Yonekawa | 123/198 D |
| 4,942,860 | 7/1990 | Chujo | 123/494 |
| 4,949,695 | 8/1990 | Uranishi | 123/494 |
| 4,961,412 | 10/1990 | Furuyama | 123/357 |
| 4,962,744 | 10/1990 | Uranishi | 123/494 |
| 5,067,461 | 11/1991 | Joachim | 123/358 |
| 5,085,197 | 2/1992 | Mader | 123/520 |

FOREIGN PATENT DOCUMENTS

| | | |
|---|---|---|
| 62-139941 | 6/1987 | Japan . |
| 63-71536 | 3/1988 | Japan . |
| 63-190541 | 12/1988 | Japan . |
| 2-245461 | 10/1990 | Japan . |

*Primary Examiner*—Carl S. Miller

*Attorney, Agent, or Firm*—Nikaido, Marmelstein, Murray & Oram

[57] ABSTRACT

An evaporative fuel-purging control system for an internal combustion engine, which controls purging of a mixture of evaporative fuel from a fuel tank and air comprises a purge control valve arranged across a purging passage for controlling the flow rate of evaporative fuel from the fuel tank to an intake passage. The flow rate of evaporative fuel is detected and compared with a desired flow rate commensurate with an operating condition of the engine. The valve opening of the purge control valve is controlled in response to results of the comparison. The change rate of the valve opening is varied according to the concentration of evaporative fuel in the mixture. Specifically, the change rate is decreased as the evaporative fuel concentration is higher.

4 Claims, 5 Drawing Sheets

EVAPORATIVE FUEL-PURGING CONTROL SYSTEM FOR INTERNAL COMBUSTION ENGINES

BACKGROUND OF THE INVENTION

1. Field of the Invention

This invention relates to an evaporative fuel-purging control system for an internal combustion engine having an evaporative emission control system.

2. Prior Art

Conventionally, evaporative emission control systems have been widely used in internal combustion engines for automotive vehicles, which operate to prevent evaporative fuel (fuel vapor) from being emitted from a fuel tank into the atmosphere, by temporarily storing evaporative fuel from the fuel tank in a canister, and purging same into the intake system of the engine. Purging of evaporative fuel into the intake system causes instantaneous enriching of an air-fuel mixture supplied to the engine. If the purged evaporative fuel amount is small, the air-fuel ratio of the mixture will then be promptly returned to a desired value, with almost no fluctuation.

However, if the purged evaporative fuel amount is large, the air-fuel ratio of the mixture fluctuates. In order to prevent fluctuations in the air-fuel ratio due to purging of evaporative fuel (fuel vapor), there have been proposed (i) an air-fuel ratio control system which is adapted to increase the control gain of air-fuel ratio control during purging of evaporative fuel from the canister into the intake pipe or within a predetermined time period after the start of the purging (Japanese Provisional Patent Publications (Kokai) Nos. 62-139941 and 63-71536, and Japanese Provisional Utility Modeal Publication No. 63-190541), and (ii) an air-fuel ratio control system which is adapted to progressively increase the valve opening of a purge control valve which controls the flow rate of a mixture supplied from the canister to the intake system of the engine, when the air-fuel ratio of the mixture detected by an air-fuel ratio sensor arranged in the exhaust system of the engine shows a value on a lean side with respect to a desired or stoichiometric air-fuel ratio (Japanese Provisional Patent Publication (Kokai) No. 2-245461).

Generally, when the concentration of evaporative fuel in a mixture purged into the intake system of the engine changes, the rate of change in the air-fuel ratio of the mixture relative to change in the valve opening of the purge control valve changes accordingly. That is, insofar as the amount of change in the valve opening of the purge control valve remains constant, the higher the evaporative fuel concentration, the greater the amount of change in the air-fuel ratio. Therefore, if the speed at which the purge control valve opens and closes, i.e. the change rate of the valve opening is set at a constant value irrespective of the evaporative fuel concentration, it will result in temporary overriching of the air-fuel ratio when the evaporative fuel concentration is high, whereas when the evaporative fuel concentration is low, the amount of fluctuation of the air-fuel ratio is so small that the air-fuel ratio control for suppression of fluctuations of the air-fuel ratio due to purging cannot be effected with sufficient responsiveness by changing the valve opening of the purge control valve.

The system (i) does not contemplate the closing and opening speed or change rate of valve opening of the purge control valve and therefore suffers from the above-mentioned disadvantage.

According to the system (ii), when the detected air-fuel ratio is on a rich side wi&h respect to the desired or stoichiometric air-fuel ratio, the valve opening of the purge control valve is held as it is. In &his sense, the opening speed of the purge control valve is changed depending upon the detected air-fuel ratio. However, the system (ii) does not directly detect the purging amount of evaporative fuel for controlling the valve opening speed and therefore cannot fully suppress fluctuations in the air-fuel ratio due to purging.

SUMMARY OF THE INVENTION

It is the object of the invention to provide an evaporative fuel-purging control system for internal combustion engines, which is capable of properly controlling the valve opening of the purge control valve to thereby fully suppress fluctuations in the air-fuel ratio due to purging.

To attain the above object, the present invention provides an evaporative fuel-purging control system for an internal combustion engine having a fuel tank and an intake passage, the evaporative fuel-purging control system including a canister for adsorbing evaporative fuel generated from the fuel tank, a purging passage connecting between the canister and the intake passage for purging a mixture of the evaporative fuel and air therethrough into the intake passage, and a purge control valve arranged across the purging passage for controlling the flow rate of the evaporative fuel supplied to the intake passage.

The evaporative fuel-purging control system according to the invention is characterized by comprising:

evaporative fuel flow rate-detecting means for detecting a flow rate of the evaporative fuel contained in the mixture;

desired evaporative fuel flow rate-setting means for setting a desired flow rate of the evaporative fuel commensurate with an operating condition in which the engine is operating;

purge control means for comparing be&ween the detected flow rate of the evaporative fuel and the set desired flow rate of the evaporative fuel and being responsive to results of the comparison for controlling valve opening of the purge control valve;

evaporative fuel concentration-detecting means for detecting concentration of the evaporative fuel in the mixture; and valve opening change rate-varying means responsive to the detected concentration of the evaporative fuel for varying a change rate of valve opening of the purge control valve.

Preferably, the valve opening change rate-varying means decreases the change rate of valve opening of the purge control valve as the detected concentration of the evaporative fuel is higher.

The above and other objects, features, and advantages of the invention will be apparent from the following detailed description taken in conjunction with the accompanying drawings.

DETAILED DESCRIPTION

The invention will now be described in detail with reference to the drawings showing an embodiment thereof.

Figure 1:
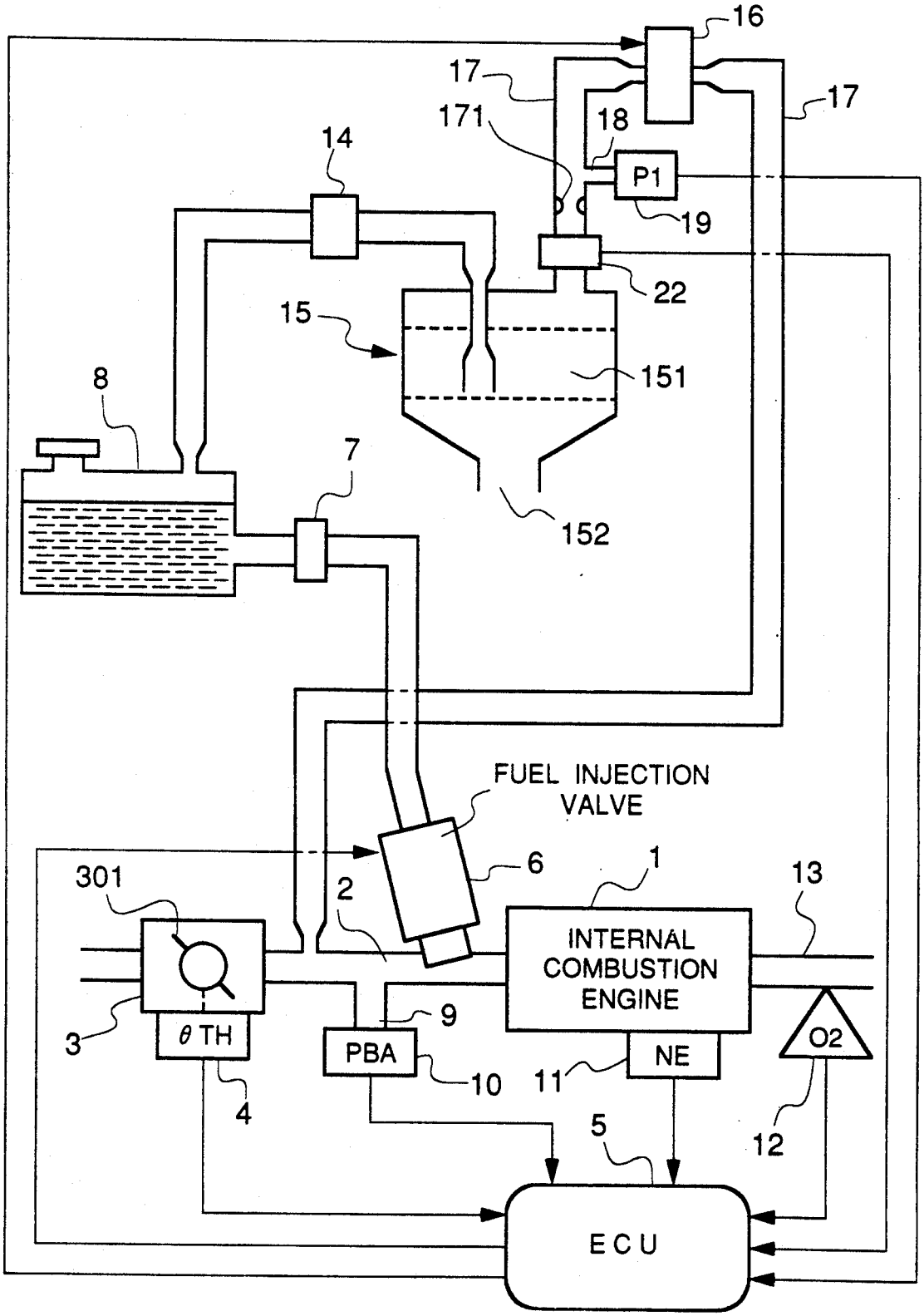
FIG. 1 is a schematic block diagram showing the whole arrangement of an internal combustion engine provided with an evaporative fuel-purging control system according to an embodiment of the invention.

Referring first to FIG. 1, there is illustrated the whole arrangement of a fuel supply control system of an internal combustion engine, including an evaporative fuel-purging control system according to an embodiment of the invention. In the FIGURE, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for generating an electric signal indicative of the sensed throttle valve opening and supplying same to an electronic control unit (hereinafter called "the ECU") 5. The ECU 5 forms part of evaporative fuel flow rate-detecting means, desired purging flow rate-setting means, purge control means, part of evaporative fuel concentration-detecting means, and valve opening change rate-varying means.

Fuel injection valves 6, only one of which is shown, are inserted into the interior of the intake pipe 2 at locations intermediate between the cylinder block of the engine I and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of predetermined crank angles whenever the crankshaft rotates through 180 degrees, the pulse being supplied to the ECU 5.

An $0_2$ sensor 12 as an exhaust gas ingredient concentration sensor is mounted in an exhaust pipe 13 connected to the cylinder block of the engine 1, for sensing the concentration of oxygen present in exhaust gases emitted from the engine 1 and supplying an electric signal indicative of the sensed value of the oxygen concentration to the ECU 5.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve 16 formed by a linear control valve which has a solenoid, not shown, for driving a valve element thereof, not shown. The solenoid of the purge control valve 16 is connected to the ECU 5 and controlled by a signal supplied therefrom to change the valve opening linearly. According to this evaporative emission control system, evaporative fuel or fuel vapor (hereinafter merely referred to as "evaporative fuel" unless otherwise specified) generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at a flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evaporative fuel generated within the fuel tank 8 is prevented from being emitted into the atmosphere.

A restriction 171 is formed in a portion of the purging passage 17 at a location between the canister 15 and the purge control valve 16. Further, a pressure gauge 19 is connected via a conduit 18 to the purging passage 17 at a location between the restriction 171 and the purge control valve 16. The pressure gauge 19 and the restriction 171 cooperate to form a differential pressure type flowmeter. The pressure gauge 19 is formed by an atmospheric pressure-based differential pressure gauge which detects relative pressure P1 within the purging passage 17 to atmospheric pressure and supplies a signal indicative of the sensed relative pressure P1 to the ECU 5. The differential pressure type flowmeter is also formed by the ECU 5 which calculates a flow rate QP1 of a mixture of evaporative fuel and air passing through the restriction 171, based on the area of the restriction 171 and a value of the relative pressure P1 detected by the pressure guage 19.

Further, a mass flowmeter 22 is arranged across the conduit line (purging passage) 17 at a location between the canister 15 and the purge control valve 16, which detects the flow rate of a mixture of evaporative fuel and air flowing in the conduct line 17 (purging flow rate) and supplies a signal indicative of the detected value of the purging flow rate to the ECU 5. The mass flowmeter 20 is a hot wire type which utilizes the nature o a plantinum wire that when the platinum wire is heated by electric current applied thereto and at the same time exposed to a flow of gas, the platinum wire loses its heat to decrease in temperature so that its electric resistance decreases. Alternatively, it may be a thermo type comprising a thermistor of which the electric resistance varies due to self-heating by electric current applied thereto or a change in the ambient temperature. Both the types of mass flowmeter detect variation in the concentration of evaporative fuel through variation in the electric resistance thereof.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes programs for calculating a control parameter DPRG for controlling the valve opening of the purge control valve 16, referred to hereinafter, etc., memory means storing a Ti map, referred to hereinafter, and the programs executed by the CPU and for storing results of calculations therefrom, etc., and an output circuit which outputs driving signals to the fuel injection valves 6 and the purge control valve 16.

The CPU operates in response to the above-mentioned engine operating parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 6 are to be opened, by the use of the following equation (1) in synchronism with inputting of TDC signal pulses to the ECU 5:

$$TOUT = Ti \times K0_2 \times K1 + K2 \quad (1)$$

where Ti represents a basic value of the fuel injection period TOUT of the fuel injection valves 6, which is read from the Ti map in accordance with the engine rotational speed NE and the intake pipe absolute pressure PBA.

$K0_2$ represents an air-fuel ratio feedback correction coefficient whose value is determined in response to the oxygen concentration in the exhaust gases detected by the $O_2$ sensor 12, during feedback control, while it is set to respective predetermined appropriate values while the engine is in predetermined operating regions (the open-loop control regions) other than the feedback control region.

K1 and K2 represent other correction coefficients and correction variables, respectively, which are calculated based on various engine operating parameter signals to such values as to optimize operating characteristics of the engine such as fuel consumption and accelerability depending on operating conditions of the engine.

The CPU supplies through the output circuit, the fuel injection valves 6 with driving signals corresponding to the calculated fuel injection period TOUT determined as above, over which the fuel injection valves 6 are opened.

Figure 2:
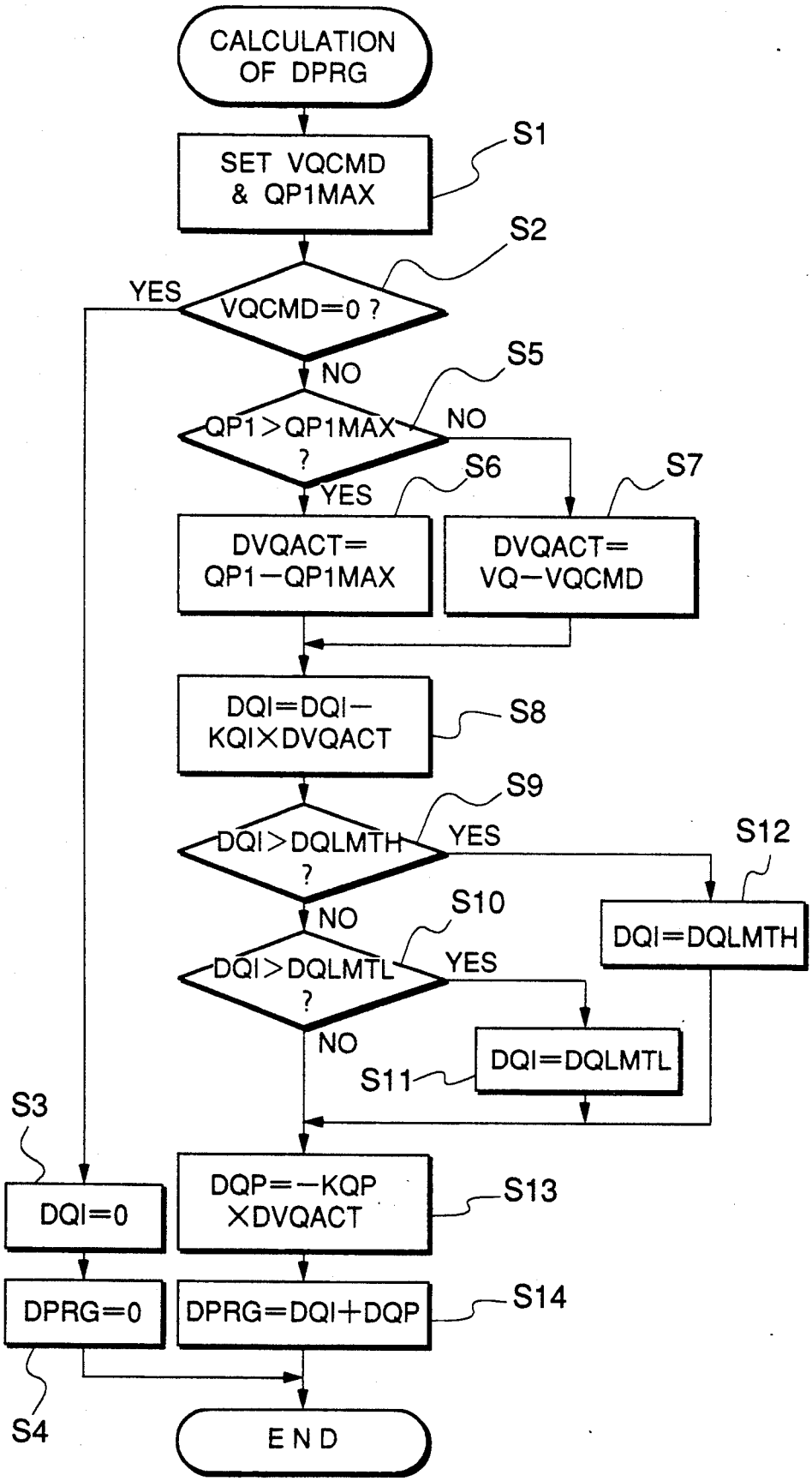
FIG. 2 is a flowchart of a program for calculating a valve opening control value DPRG for a purge control valve in FIG. 1.

FIG. 2 shows a program for calculating the control parameter DPRG for controlling the valve opening of the purge control valve 16.

First, at a step S1, setting is made of a desired value VQCMD of the flow rate of evaporative fuel in a mixture flowing in the purging passage 17 (hereinafter referred to as "vapor flow rate") VQ, and the maximum value QPIMAX of a purging flow rate (actual flow rate of the mixture of evaporative fuel and air supplied to the intake pipe 2 through the purging passaage 17). The desired vapor flow rate VQCMD is calculated by multiplying an engine intake air amount which is calculated based upon the fuel injection period Tout and the engine rotational speed NE, by a coefficient which is calculated based upon the engine rotational speed NE and the intake pipe absolute pressure PBA. The maximum allowable purging flow rate QP1MAX, hereinafter referred to, is read from a table shown, e.g. in FIG. 3, according to the desired vapor flow rate VQCMD.

At the next step S2, it is determined whether or not the desired vapor flow rate VQCMD is equal to 0. If the answer is affirmative (Yes), an integral term (I term) DQI for use in the air-fuel ratio feedback control and the valve opening control parameter DPRG are both set to 0 at steps S3, S4, respectively followed by terminating the program.

If the answer to the question of the step S2 is negative (No), i.e. if VQCMD>0, it is determined at a step S5 whether or not the purging flow rate QP1 is greater than the maximum allowable value QP1MAX. If the answer is negative (No), i.e. if QP1≦QPIMAX, a difference DVQACT between the detected vapor flow rate VQ and the desired vapor flow rate VQCMD is calculated by the use of the following equation (2), at a step S7:

$$DVQACT = VQ - VQCMD \quad (2)$$

The vapor flow rate VQ is calculated from an output value QS indicated by the differential pressure type flowmeter formed of the pressure gauge 19 and the restriction 171 and an output value QH indicated by the hot-wire type flowmeter 22. This is based on the ground that as the vapor concentration in the mixture flowing in the purging passage 17 varies, the QS and QH values vary even if the purging flow rate QP1 remains constant. More specifically, the two flowmeters of different types 19, 171; 22 both indicate output values which vary at respective different rates relative to the actual flow rate, as the density of an object gas (in the present case, the mixture of evaporative fuel and air) i.e. vapor concentration varies. For example, even if the actual volumetric flow rate remains constant, they indicate different output values (indication amounts) between when the object gas is formed of 100% air (i.e. low density) and when the object gas is formed of 100% vapor (HC) (i.e. high density). When the gas is formed of 100% air, they output small values, whereas when the gas is formed of 100% vapor, they output large values. Further, the differential pressure type flowmeter shows a different output characteristic curve relative to change in the density of the object gas, i.e. vapor concentration, from that of the mass flowmeter. For example, when the mixture is formed of 100% air, both the flowmeters indicate an output value of 1.0, whereas when the mixture is formed of 100% vapor, the differential pressure type flowmeter indicates an output value of 1.69, while the mass flowmeter an output value of 4.45.

Figure 6:
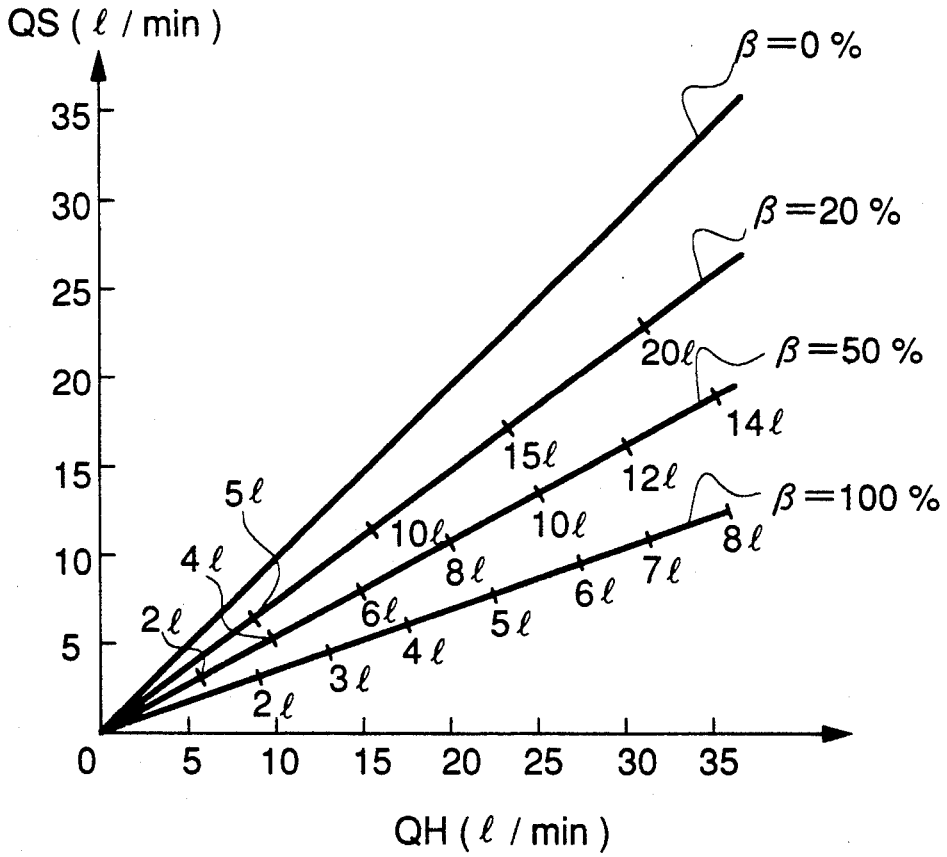
FIG. 6 shows a table for determining vapor flow rate VQ, vapor concentration $\beta$, and purging flow rate QP1, based upon output values QS and Q/H from flowmeters.

Therefore, not only the vapor flow rate VQ but also the vapor concentration $\beta$ and the purging flow rate QP1 can be determined from the QS and QH values from the two types of flowmeters 19, 171; 22 which have different output characteristics from each other as well as relative to change in the vapor concentration $\beta$. For example, these parameters can be read from a table shown, e.g. in FIG. 6, according to the detected QS and QH values. In this connection, values of the purging flow rate QP1 are indicated as 11, 21, ... along lines dependent upon the vapor concentration $\beta$ (when $\beta=0\%$, QP1=QS=QH), and the vapor flow rate VQ is obtained as $QP1\times\beta$.

If the answer to the question of the step S5 is affirmative (Yes), i.e. if QP1>QP1MAX, the difference DVQACT is calculated by the use of the following equation (3):

$$DVQACT=QP1-QP1MAX \quad (3)$$

Figure 4:
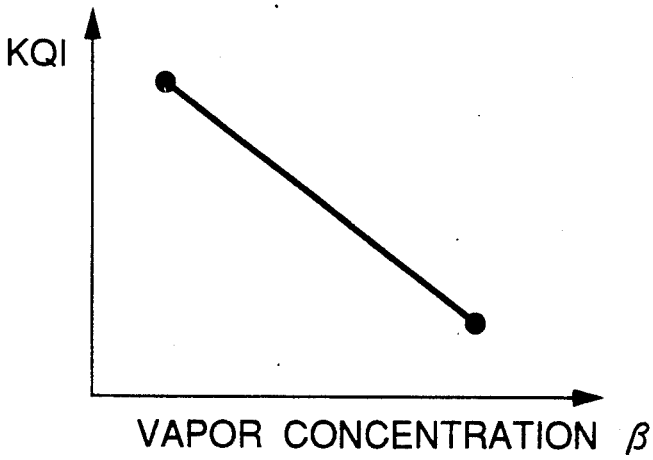
FIG. 4 shows a table of an integral term gain-setting coefficient KQI vs. vapor concentration $\beta$, used in executing the program of FIG. 2.

At a step S8 following the step S6 or S7, the difference DVQACT thus obtained is substituted into the following equation (4) to calculate I term DQI for effecting the air-fuel ratio feedback control:

$$DQI=DQI-KQI\times DVQACT \quad (4)$$

where DQI on the right side represents an I term obtained up to the last loop, and KQI represents an I term gain-setting coefficient& which is read from a KQI table shown, e.g. in FIG. 4, according to the vapor concentration $\beta$. The KQI table in FIG. 4 is set such that as the vapor concentration $\beta$ is higher, the KQI value is set to smaller values.

The I term DQI thus obtained is subjected to limit checking at steps S9 to S12. More specifically, when the DQI value is greater than a predetermined upper limit value DQLMTH (the answer to the question of the step S9 is affirmative (Yes)), the DQI value is set equal to the predetermined upper limit value DQLMTH (step S12), whereas when the DQI value is equal to or smaller than a predetermined lower limit value DQLMTL (the answer to the question of the step S10 is affirmative (Yes)), the DQI value is set equal to the predetermined lower limit value DQLMTL at a step S11, followed by the program proceeding to a step 13, while if the answers to the steps S9 and S10 are both negative (No), the program jumps to the step S13.

Figure 5:
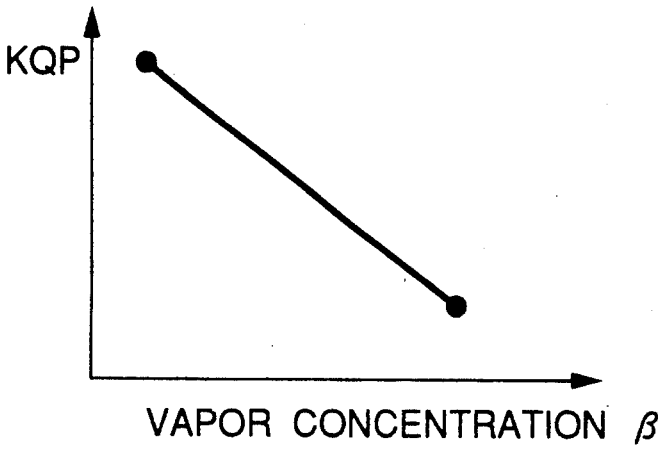
FIG. 5 shows a table of a proportional term gain-setting coefficient KQP vs. vapor concentration $\beta$.

At the step S13, the difference DVQACT calculated at the step S6 or S7 is substituted into following equation (5) to calculate a proportional term (P term) DQP for effecting the air-fuel ratio feedback control:

$$DQP=KQP\times DVQACT \quad (5)$$

where KQP represents a P term gain-setting coefficient and read from a KQP table shown in FIG. 5, according to the vapor concentration $\beta$. The KQP table is set such that as the vapor concentration $\beta$ is higher, the KQP value is set to smaller values.

Then, at a step S14, the I term DQI and the P term DQP determined as above are added together to obtain the control value DPRG for control of the purge control valve 16.

According to the manner of FIG. 2 described above, as the vapor concentration $\beta$ is higher, the control gain-setting coefficients KQI, KQP are set to smaller values. As a result, the opening and closing speed or valve opening change rate of the purge control valve 16 decreases as the vapor concentration $\beta$ becomes higher.

Figure 7:
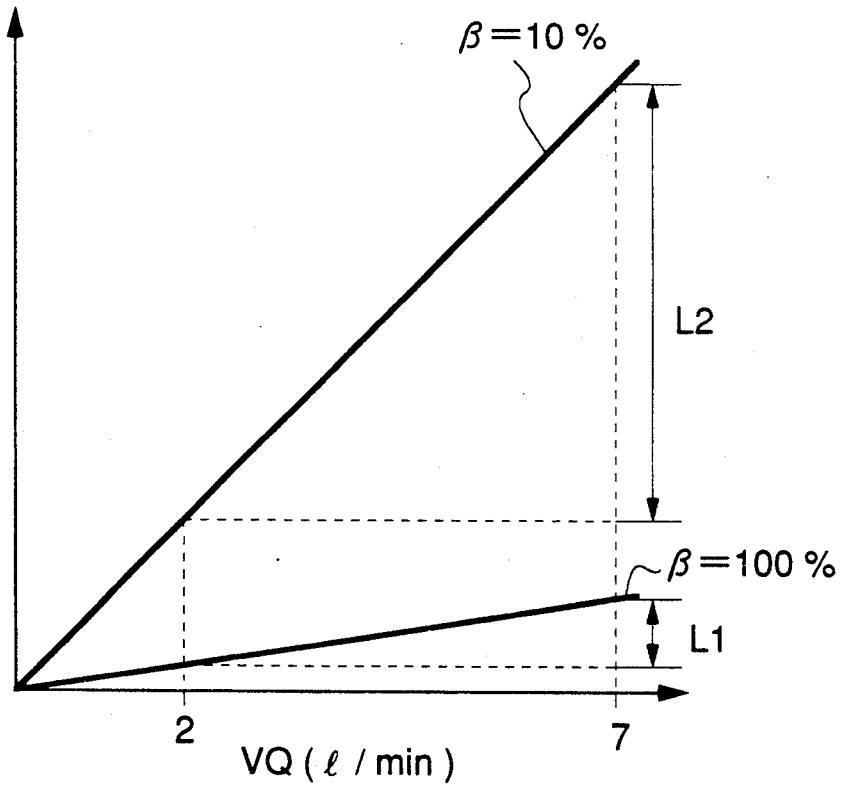
FIG. 7 is a graph showing the relationship between vapor flow rate VQ and valve lift of the purge control valve.

This control manner can eliminate the following disadvantage with the conventional evaporative fuel-purging control system:

The relationship between the vapor flow rate VQ and the valve opening (valve lift) of the purge control valve varies with change in the vapor concentration $\beta$, as shown, e.g. in FIG. 7. For example, as can be understood from the FIGURE, to increase the vapor flow rate VQ from 2 l/min to 7 l/min, the valve lift has only to be increased by an amount L1 when $\beta=100\%$, whereas it has to increased by a much larger amount L2 when $\beta=10\%$. Consequently, if the purge control valve is opened or closed at a constant speed, when $\beta=10\%$, the control responsiveness is degraded, i.e. L2/L1 times as low as when $\beta=100\%$ (7~8 times in the illustrated example). Therefore, according to the invention, the change rate of the valve opening of the purge control valve 16 is varied according to the vapor concentration $\beta$ to secure satisfactory control responsiveness irrespective of the actual vapor concentration$\beta$ and hence reduce fluctuations in the air-fuel ratio during the purging.

Further, in the above described embodiment, when QP1≦QP1MAX stands, the valve opening of the purge control valve 16 is controlled such that the vapor flow rate VQ becomes equal to the desired value VQCMD, whereas when QP1>QPIMAX stands, the purging flow rate QP1 becomes equal to the maximum allowable value QP1MAX.

The reason for thus controlling the purging flow rate QP1 to the maximum allowable value QPIMAX when the former exceeds the latter is as follows, The actual maximum value of the purging flow rate QP1 is determined by the construction and size of the purging passage 17 and the purge control valve 16, and is usually of the order of 100 l/min. However, the detected value of vapor concentration $\beta$ usually contains an error of the order of $\pm1\%$. Therefore, when the purging flow rate QP1 assumes the maximum value, e.g. 100 l/min, the resulting error in the vapor flow rate VQ is $10\times0.01=1$ l/min. As can be understood from FIG. 6, as the vapor concentration $\beta$ becomes lower, the purging flow rate QP1 is controlled to a greater value so that it is very likely to reach the maximum flow rate, whereby the error in the vapor flow rate VQ becomes significantly greater, adversely affecting the accuracy of control of the vapor flow rate. Particularly, this is conspicuous in the case where the purging flow rate QP1 is brought to the maximum flow rate when the required vapor flow rate VQ is small.

Figure 3:
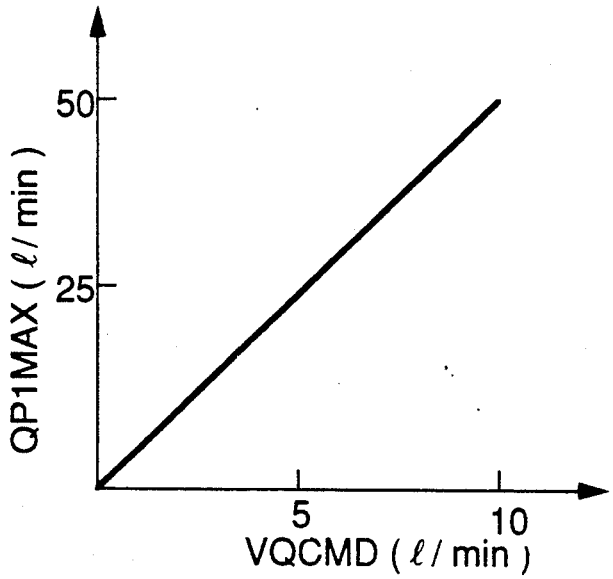
FIG. 3 shows a table of maximum allowable vapor flow rate QPIMAX vs. desired vapor flow rate VQCMD, used in executing the program of FIG. 2.

On the other hand, according to the present embodiment, as shown in FIG. 3, the maximum allowable flow rate QP1MAX is set to smaller values as the desired vapor flow rate VQCMD is smaller. In the example of FIG. 3, when VQCMD=10 l/min, QPIMAX=50 l/min so that the maximum error in the vapor flow rate VQ is $50\times0.01=0.5$ (l/min), while when VQCMD=5 l/min, QP1MAX=25 l/min so that the maximum error is $25\times0.01=0.25$ (l/min). Thus, as compared with the case where the maximum allowable flow rate QP1MAX is not controlled according to the vapor concentration $\beta$, it is possible to reduce the absolute error by the greater amount as the desired vapor flow rate VQCMD is smaller.

As described in detail above, according to the invention, the valve opening of the purge control valve is controlled such that the detected evaporative fuel flow rate becomes equal to the desired value, while the change rate of the valve opening of the purge control valve is varied according to the concentration of evaporative fuel. As a result, satisfactory control responsiveness can be secured irrespective of the evaporative fuel concentration, thereby reducing fluctuations in the air-fuel ratio during purging.

What is claimed is:

1. In an evaporative fuel-purging control system for an internal combustion engine having a fuel tank and an intake passage, said evaporative fuel-purging control system including a canister for adsorbing evaporative fuel generated from said fuel tank, a purging passage connecting between said canister and said intake passage for purging a mixture of said evaporative fuel and air therethrough into said intake passage, and a purge control valve arranged across said purging passage for controlling a flow rate of said evaporative fuel supplied to said intake passage, the improvement comprising:

evaporative fuel flow rate-detecting means for detecting a flow rate of said evaporative fuel contained in said mixture;

desired evaporative fuel flow rate-setting means for setting a desired flow rate of said evaporative fuel commensurate with an operating condition in which said engine is operating;

purge control means for comparing between the detected flow rate of said evaporative fuel and the set desired flow rate of said evaporative fuel and being responsive to results of said comparison for controlling valve opening of said purge control valve;

evaporative fuel concentration-detecting means for detecting the concentration of said evaporative fuel in said mixture; and valve opening change rate-varying means responsive to the detected concentration of said evaporative fuel for varying a change rate of valve opening of said purge control valve.

2. An evaporative fuel-purging control system as claimed in claim 1, wherein said valve opening change rate-varying means decreases said change rate of valve opening of said purge control valve as the detected concentration of said evaporative fuel is higher.

3. An evaporative fuel-purging control system as claimed in claim 1, including:

maximum allowable flow rate-setting means responsive to the set desired flow rate of said evaporative fuel for setting a maximum allowable purging flow rate of said mixture; and mixture flow rate-calculating means for calculating a purging flow rate of said mixture; and wherein said purge control means compares between the calculated purging flow rate of said mixture and the set maximum allowable purging flow rate thereof, and controls the valve opening of said purge control valve such that the calculated purging flow rate becomes equal to the set maximum allowable purging flow rate when the former exceeds the latter.

4. An evaporative fuel-purging control system as claimed in claim 3, wherein said maximum allowable flow rate-setting means sets said maximum allowable purging flow rate such that as said desired flow rate of said evaporative fuel is smaller, said maximum allowable purging flow rate is smaller.

* * * * *